US008208828B2

(12) United States Patent
Tomita et al.

(10) Patent No.: US 8,208,828 B2
(45) Date of Patent: Jun. 26, 2012

(54) IMAGE FORMING APPARATUS AND JOB EXECUTION METHOD

(75) Inventors: Atsushi Tomita, Toyohashi (JP); Kenichi Sawada, Toyohashi (JP); Katsushi Sukigara, Hoi-gun (JP); Shoko Haba, Toyokawa (JP); Takatsugu Kuno, Hoi-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 421 days.

(21) Appl. No.: 12/476,725

(22) Filed: Jun. 2, 2009

(65) Prior Publication Data

US 2009/0317121 A1 Dec. 24, 2009

(30) Foreign Application Priority Data

Jun. 18, 2008 (JP) ..... 2008-159507

(51) Int. Cl.
*G03G 15/00* (2006.01)

(52) U.S. Cl. ..... 399/82

(58) Field of Classification Search ..... 399/37, 399/82, 83, 85, 43; 358/1.13, 1.14
See application file for complete search history.

(56) References Cited

U.S. PATENT DOCUMENTS

| | | | | |
|---|---|---|---|---|
| 5,717,841 | A * | 2/1998 | Farrell et al. | 358/1.15 |
| 6,058,249 | A * | 5/2000 | Matsuda et al. | 358/1.14 |
| 6,801,730 | B2 * | 10/2004 | Johnson et al. | 399/75 |
| 7,142,321 | B2 * | 11/2006 | Tomita et al. | 358/1.15 |
| 7,312,882 | B2 | 12/2007 | Hino et al. | |
| 7,869,733 | B2 * | 1/2011 | Sato | 399/82 |
| 2002/0015172 | A1 | 2/2002 | Sugita | |

FOREIGN PATENT DOCUMENTS

| | | | |
|---|---|---|---|
| JP | 10-269042 | | 10/1998 |
| JP | 11-150616 | | 6/1999 |
| JP | 11-355498 | | 12/1999 |
| JP | 2000357215 | A * | 12/2000 |
| JP | 2002-059617 | | 2/2002 |
| JP | 2002-154683 | | 5/2002 |
| JP | 2003-44308 | A | 2/2003 |
| JP | 2003-078672 | | 3/2003 |
| JP | 2003-167823 | | 6/2003 |
| JP | 2003220742 | A * | 8/2003 |
| JP | 2003259043 | A * | 9/2003 |

(Continued)

OTHER PUBLICATIONS

Notification of Reason(s) for Refusal issued in corresponding Japanese Patent Application No. 2008-159507 dated Feb. 2, 2010, and an English Translation thereof.

*Primary Examiner* — Robert Beatty
(74) *Attorney, Agent, or Firm* — Buchanan Ingersoll & Rooney PC

(57) ABSTRACT

An image forming apparatus is provided with a job storage portion that stores a print job relating to an image forming process and a command job relating to a control process of operation of the image forming apparatus, a job management portion that registers the print job and the command job in the job storage portion and manages the print job and the command job, an image formation portion that executes the print job, a command execution portion that executes the command job, and a controller that performs control such that the print job stored in the job storage portion is executed ahead of the command job.

10 Claims, 11 Drawing Sheets

FOREIGN PATENT DOCUMENTS

| | | | | |
|---|---|---|---|---|
| JP | 2005288971 | A | * | 10/2005 |
| JP | 2005-313488 | | | 11/2005 |
| JP | 2006-025137 | | | 1/2006 |
| JP | 2006-159514 | | | 6/2006 |
| JP | 2006-184541 | A | | 7/2006 |
| JP | 2006-256168 | | | 9/2006 |
| JP | 2007098590 | A | * | 4/2007 |

* cited by examiner

FIG. 6A

JT

| ID | TYPE OF JOB | DOC. NAME | RECEIVED DATE AND TIME | JOB DATA | |
|---|---|---|---|---|---|
| 0101 | PRINT JOB | 123.doc | DECEMBER 10, 2007 22:13 | 123.bin | JJ1(JJ) |
| 0102 | PRINT JOB | qwe.doc | DECEMBER 10, 2007 22:18 | qwe.bin | JJ2(JJ) |
| 0103 | PRINT JOB | asd.doc | DECEMBER 10, 2007 22:20 | asd.bin | JJ3(JJ) |
| 0104 | COMMAND JOB (ACTIVATION OF POWER-SAVING MODE) | | DECEMBER 10, 2007 22:23 | | JJ4(JJ) |
| ⋮ | ⋮ | ⋮ | ⋮ | ⋮ | |

FIG. 6B

JT

| ID | TYPE OF JOB | DOC. NAME | RECEIVED DATE AND TIME | JOB DATA | |
|---|---|---|---|---|---|
| 0103 | PRINT JOB | asd.doc | DECEMBER 10, 2007 22:20 | asd.bin | JJ3(JJ) |
| 0105 | PRINT JOB | zxc.doc | DECEMBER 10, 2007 22:27 | zxc.bin | JJ5(JJ) |
| 0110 | COMMAND JOB (ACTIVATION OF POWER-SAVING MODE) | | DECEMBER 10, 2007 22:30 | | JJ6(JJ) |
| ⋮ | ⋮ | ⋮ | ⋮ | ⋮ | |

FIG. 7

ZT

| ID | EXECUTION DATA AND TIME |
|---|---|
| 0110 | DECEMBER 11, 2007 22:30 |
| ⋮ | ⋮ |

ZJ

FIG. 8

JT

| ID | TYPE OF JOB | DOC. NAME | RECEIVED DATE AND TIME | JOB DATA | |
|---|---|---|---|---|---|
| 0102 | PRINT JOB | qwe.doc | DECEMBER 10, 2007 22:18 | qwe.bin | JJ2(JJ) |
| 0103 | PRINT JOB | asd.doc | DECEMBER 10, 2007 22:20 | asd.bin | JJ3(JJ) |
| 0111 | PRINT JOB | zxc.doc | DECEMBER 10, 2007 22:32 | zxc.bin | JJ7(JJ) |
| 0104 | COMMAND JOB (ACTIVATION OF POWER-SAVING MODE) | | DECEMBER 10, 2007 22:30 | | JJ6(JJ) |
| ⋮ | ⋮ | ⋮ | ⋮ | ⋮ | |

IMAGE FORMING APPARATUS AND JOB EXECUTION METHOD

This application is based on Japanese Patent Application No. 2008-159507 filed on Jun. 18, 2008, the contents of which are hereby incorporated by reference.

BACKGROUND OF THE INVENTION

1. Field of the Invention

The present invention relates to an image forming apparatus such as an MFP and a job execution method.

2. Description of Related Art

Image forming apparatuses for forming images such as copying machines, printers, and facsimiles and, in addition, multi function peripherals known as combination machines or MFPs (Multi Function Peripherals) have been traditionally used in the offices of business and the like.

It is sometimes a case where the image forming apparatus is powered off or the operation mode thereof is turned into a power-saving mode for reducing power consumption thereof during such a period as at night or a lunch break.

Against this background, a method has been conventionally used to turn the operation mode of the image forming apparatus into the power-saving mode at a preprogrammed time or deactivate the power-saving mode at a preprogrammed time.

For example, JP-2006-184541-A discloses a method in which, while a current job is executed, a different job for turning an apparatus into a power-saving mode at the conclusion of a predetermined elapsed time subsequent to the completion of the current job is reserved, and the different job thus reserved will be executed to turn the mode from the normal operation mode into the power-saving mode.

As an image forming apparatus capable of controlling an execution sequence of different types of jobs in an appropriate manner, JP-2003-044308-A discloses an apparatus that performs a firmware rewriting job and another job such as a print job in appropriate execution order.

On the other hand, depending on the user, the user may wish the image forming apparatus to perform an image forming process that requires a considerable amount of time at night, and, upon its completion, to turn the operation mode of the image forming apparatus into the power-saving mode. Also, there may be a case in which the user finds that it will take a long time before the image forming process to be completed once it has started, but finds that the user can not wait until the image forming process to be completed because of another engagement the user must attend or the like. As seen in this example, there is a case where a user wishes to change the preprogrammed time to a different time for turning the mode into the power-saving mode.

However, according to the conventional methods as described above, it is necessary to register a time at which the operation mode of the image forming apparatus is turned into the power-saving mode or the power-saving mode is deactivated. Accordingly, if the user wishes to change a time at which the power-saving mode is activated or deactivated, such a registration procedure is a burdensome task.

In addition, it is quite a troublesome work if the user wishes the image forming apparatus to execute a predetermined job temporarily at a time different from a preprogrammed time set therein and if the preprogrammed time must be restored after the predetermined job is executed at the time thus changed. Moreover, if a plurality of different sets of time are to be programmed for individual users, it is difficult to configure such different sets of time in response to the individual users' demands. As described above, the conventional method lacks user-friendliness in a method for configuring execution of jobs.

SUMMARY OF THE INVENTION

In view of such problems, it is an object of the present invention to provide a way for configuring execution of jobs easier and simpler than conventionally performed.

According to one embodiment of the present invention, an image forming apparatus includes a job storage portion that stores a print job relating to an image forming process and a command job relating to a control process of operation of the image forming apparatus, a job management portion that registers the print job and the command job in the job storage portion and manages the print job and the command job, an image formation portion that executes the print job, a command execution portion that executes the command job, and a controller that performs control such that the print job stored in the job storage portion is executed ahead of the command job.

BRIEF DESCRIPTION OF THE DRAWINGS

FIGS. 6A and 6B are diagrams illustrating an example of a job management table.

FIG. 7 is a diagram illustrating an example of an execution date/time management table.

FIG. 8 is a diagram illustrating an example of a job management table.

DESCRIPTION OF THE PREFERRED EMBODIMENTS

Figure 1:
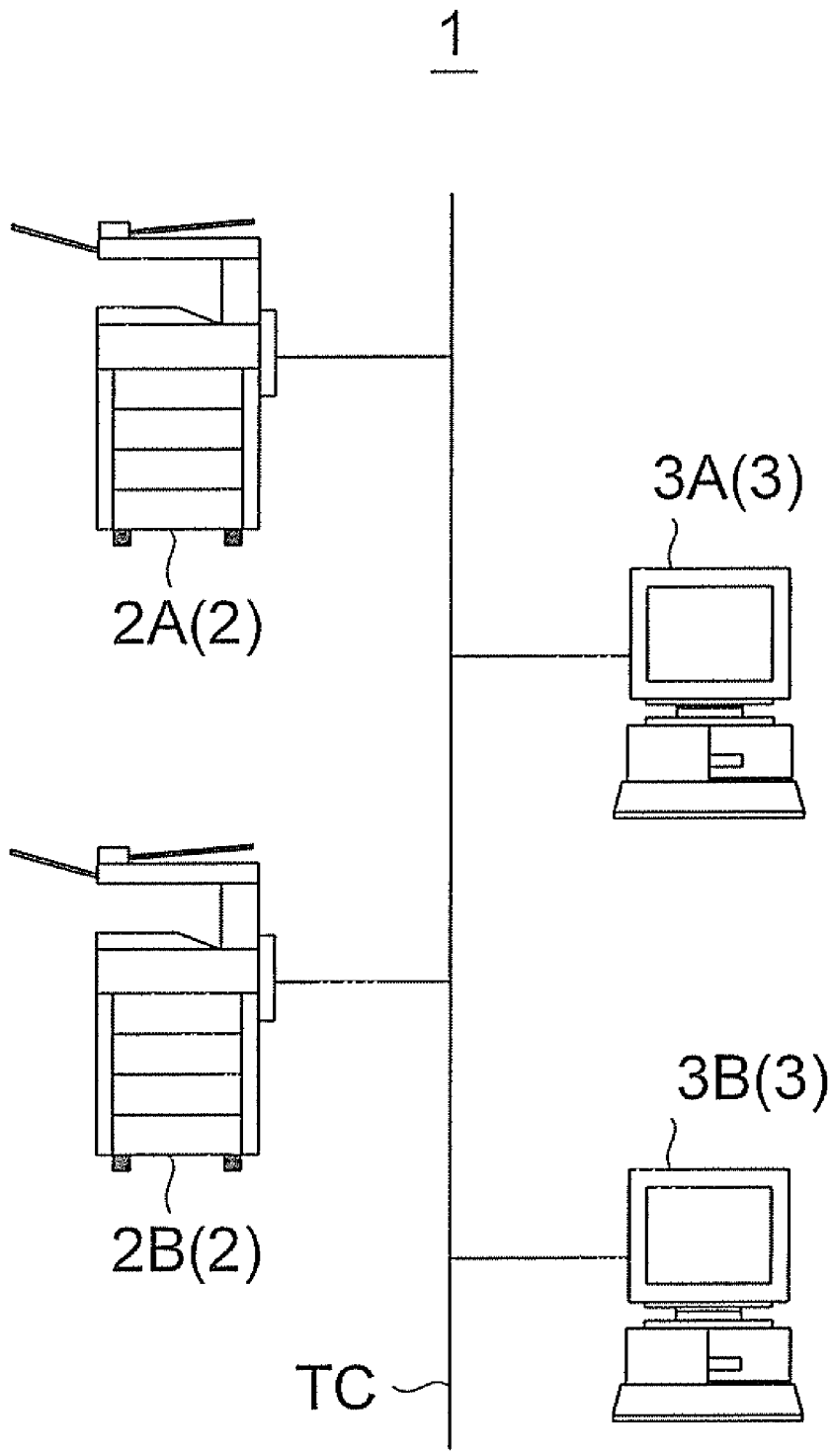
FIG. 1 is a diagram illustrating an example of a system configuration including an image forming apparatus according to an embodiment of the present invention.
Figure 2:
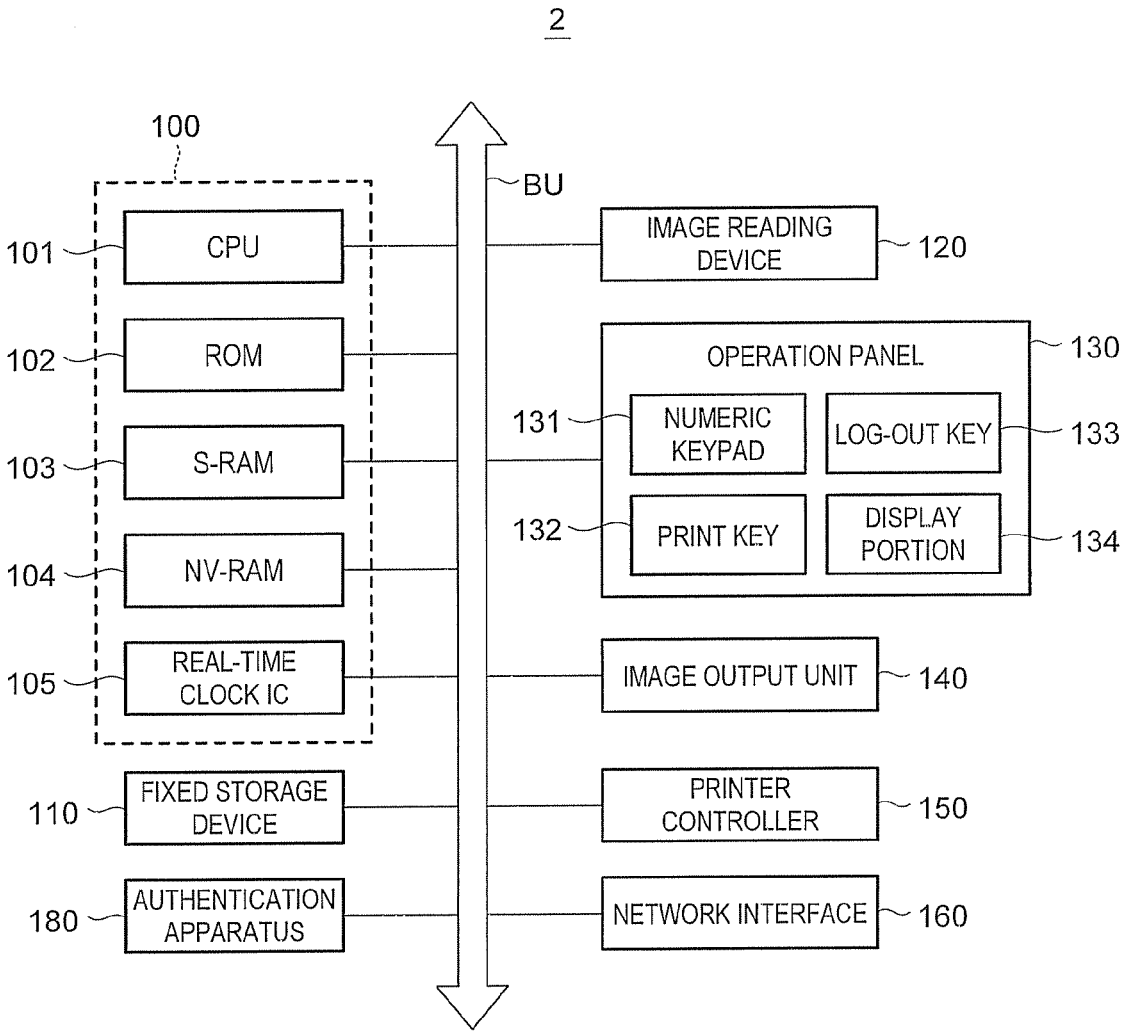
FIG. 2 is a diagram illustrating an example of a hardware configuration of the image forming apparatus.
Figure 3:
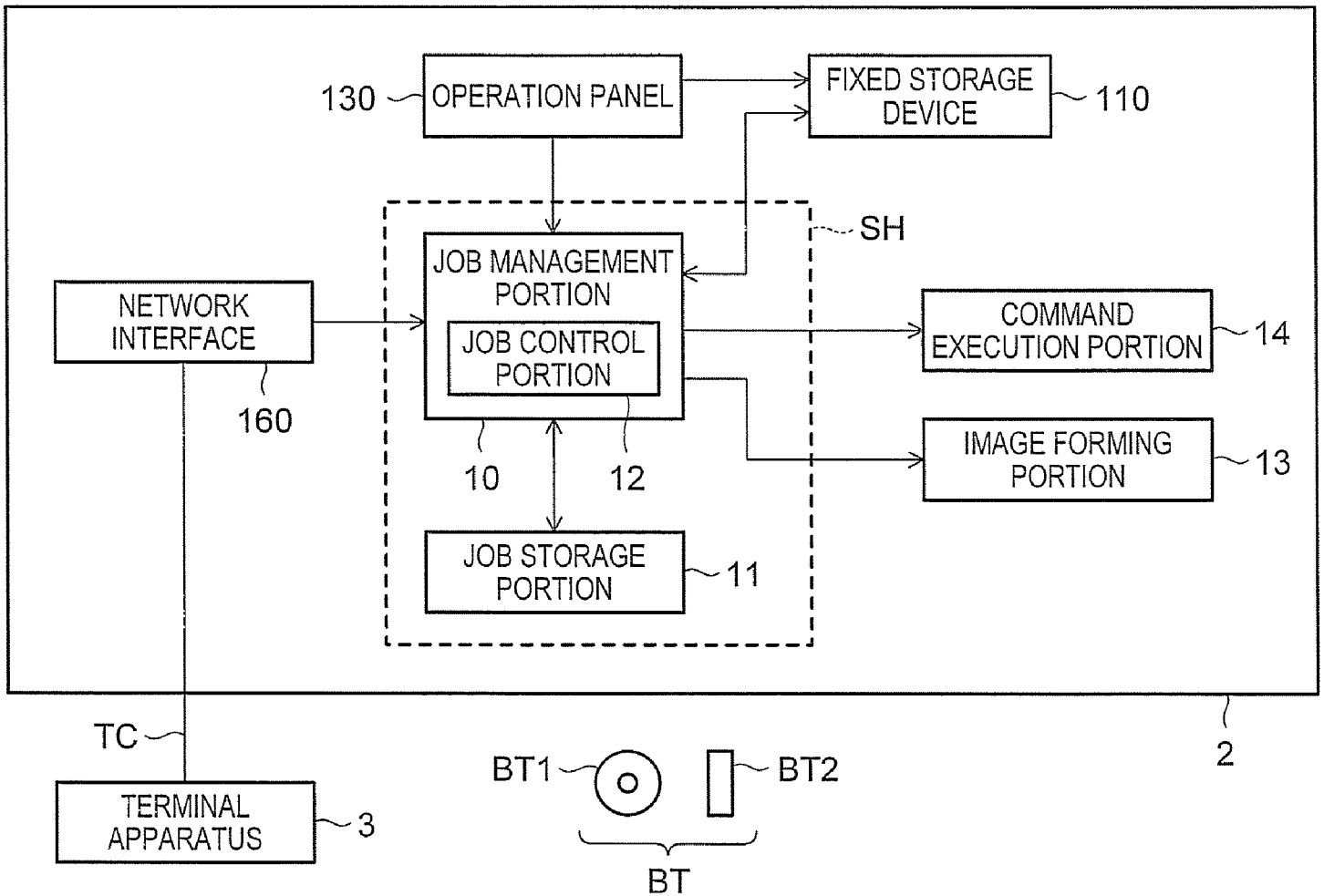
FIG. 3 is a diagram illustrating an example of a functional configuration of the image forming apparatus.

FIG. 1 is a diagram illustrating an example of a configuration of a system 1 including an image forming apparatus 2 according to an embodiment of the present invention; FIG. 2 is a diagram illustrating an example of a hardware configuration of the image forming apparatus 2; FIG. 3 is a diagram illustrating an example of a functional configuration of the image forming apparatus 2.

As illustrated in FIG. 1, the system 1 is configured of a plurality of image forming apparatuses 2A, 2B, and so on (collectively denoted by reference numeral 2), a plurality of terminal apparatuses 3A, 3B, and so on (collectively denoted by reference numeral 3), a communication line TC, and the like. A LAN, the Internet, a public line, a wireless line, a private line, or the like is used as the communication line TC.

In this system 1, the image forming apparatuses 2 and the terminal apparatuses 3 are connected to each another through the communication line TC.

The terminal apparatus 3, working as a client of the image forming apparatus 2, is an apparatus that uses functions such as scanning, faxing, a box function, and a PC printing of the image forming apparatus 2.

The image forming apparatus 2 is a processing apparatus for printing, onto paper, an image based on image data generated by scanning a document by an image reading device (scanner) and an image based on image data (hereinafter, referred to as "print data") included in a print job transmitted from the terminal apparatus 3. The image forming apparatus 2 is sometimes called a combination machine or an MFP (Multi Function Peripheral).

The image forming apparatus 2 is installed in the offices of a public institution (central government, local government), a company, or the like, is also installed in public facilities such as schools or libraries, or various other locations, and can be used by a plurality of users.

The print data described above is a draw command converted, by a printer driver, from a draw command created by an operating system or an application program running on the terminal apparatus 3, into a page description language that can be processed by the image forming apparatus 2, or document data compiled in a file format such as PDF, TIFF, JPEG, or XPS.

It is possible to transmit image data generated by the image reading device of the image forming apparatus 2 to the terminal apparatus 3 or another image forming apparatus 2 via the communication line TC.

The terminal apparatus 3 is a typical computer including a CPU, a RAM, a fixed storage device (hard disk device etc.), a monitor, a keyboard, a mouse, and so on. The terminal apparatus 3, in accordance with instructions by a user, generates print data and transmits the print data thus generated to the image forming apparatus 2.

As illustrated in FIG. 2, a ROM 102 storing a control program, an S-RAM (Static Random Access Memory) 103 as a working storage, a battery-backed NV-RAM (Non-Volatile Random Access Memory) 104 storing various settings relating to image formation, and a real-time clock IC (integrated circuit) 105 are connected to a CPU 101 of the image forming apparatus 2 via a bus BU. A controller 100 is configured of the CPU 101, the ROM 102, the S-RAM 103, the NV-RAM 104, and the real-time clock IC 105.

Connected to the controller 100 respectively via the bus BU are an image reading device (scanner) 120 for reading a document and generate image data thereof, an operation panel 130 for a user to perform various settings thereon, an image output unit (printer) 140 for printing an image based on the image data onto paper, a network interface 160 for transmitting and receiving various types of information to and from an external device such as the terminal apparatus 3, a printer controller 150 for generating an image to be copied from print data received through the network interface 160, and so on.

The operation panel 130 is configured of a display portion 134 and an operation portion. The display portion 134 is constructed of a touch-panel liquid crystal display, and the operation portion is constructed of a numeric keypad 131, a print key 132, log-out key 133, and so on. The display portion 134 displays a screen for giving a user messages or instructions, a screen for a user to enter a desired processing type and condition, and a screen showing results of processing executed by the CPU 101 or the like.

The user can perform operation on the display portion 134 or the operation portion while viewing the screen; give instructions to start or halt execution of a process; specify a destination to which data is transmitted, printing conditions, or processing conditions such as scanning conditions; and specify various other items. In other words, the operation panel 130 serves as a user interface for a user to operate the image forming apparatus 2.

For example, a fixed storage device 110 formed of a hard disk device and an authentication apparatus 180 such as a biometric authentication apparatus are connected to the controller 100 via the bus BU. The authentication apparatus 180 is used when an authenticated print job is performed. The authenticated print job is a print job that is executed when a user, who has transmitted the print job from the terminal apparatus 3 to the image forming apparatus 2, has performed a predetermined authentication operation on the authentication apparatus 180 provided to the image forming apparatus 2 and succeeded in the authentication process.

As shown in FIG. 3, the image forming apparatus 2 is configured of a job management portion 10, a job storage portion 11, a job control portion 12, an image forming portion 13, a command execution portion 14, and so on. The job control portion 12 is formed within the job management portion 10.

The job management portion 10, the job storage portion 11, and the job control portion 12 are functionally implemented by the CPU 101, the ROM 102, the S-RAM 103, and a processing portion SH formed of other peripheral devices. The job storage portion 11 is functionally implemented by the S-RAM 103 and the NV-RAM 104.

All or part of CPU 101 or the like may be sometimes implemented for use as a microcomputer or an ASIC (Application Specific Integrated Circuit) in a form of LSI.

The processing portion SH incorporates a computer program for realizing each of the functions of the job management portion 10, the job storage portion 11, and the job control portion 12. Such a program can be installed from a portable recording medium BT including a recording medium BT1 such as a CD-ROM, a DVD-ROM, or the like having the program recorded therein or a recording medium BT2 such as a semiconductor memory having the program recorded therein. It is also possible to download the program from a server by way of a network.

The image forming apparatus 2 includes, as operation modes, a normal operation mode and a sleep mode (power-saving mode) consuming less power than in the normal operation mode.

First, the job management portion 10 receives a print job from the terminal apparatus 3 through the network interface 160. The job management portion, then, registers the print job in a job management table, which will be described later, of the job storage portion 11. At the same time, the job management portion 10 receives a command job issued through the operation by a user on the operation panel 130.

The command job is, for example, such a job for turning off the power of the image forming apparatus 2 or turning the normal operation mode, when it is programmed so in the image forming apparatus 2, into the sleep mode. In other words, the command job is for controlling the operation of the image forming apparatus 2.

The job management portion 10 also registers the command job in the job management table, which will be described later, of the job storage portion 11 or deletes the command job from the job management table.

The job management portion 10 further registers information relating to starting execution of the command job in an execution date/time management table, which will be described later, of the job storage portion 11, or deletes the information from the execution date/time management table.

The job control portion 12 performs control in such a manner that the print job is executed always ahead of the command job based on the job management table which will be described later. In other words, the command job is executed after the registered print jobs have been executed.

The image forming portion 13 is a typical structural portion used for performing an image forming process relating to the print job, and corresponds to an unillustrated image processing portion, the image output unit 140, or the like.

The command execution portion 14 executes the command job. For example, the command execution portion 14 turns off the power of the image forming apparatus 2 or changes locations to which power is supplied in accordance with the configuration of the operation mode of the image forming apparatus 2. For example, when the operation mode of the image forming apparatus 2 is turned from the normal operation mode into the sleep mode, the command execution portion 14 operates so as not to supply power to an unillustrated fixing unit, the image reading device 120, the display portion 134 of the operation panel 130, and the like. In this way, the operation mode of the image forming apparatus 2 shifts into the sleep mode.

The job management portion 10 also performs a process of registering by registering a command job stored in the fixed storage device 110 into the job storage portion 11 when date and time which was configured by a user and at which the command job is configured to be executed has lapsed.

Hereinafter, referring to flowcharts, a detailed description will be given of a job execution method performed by the image forming apparatus 2.

Figure 4:
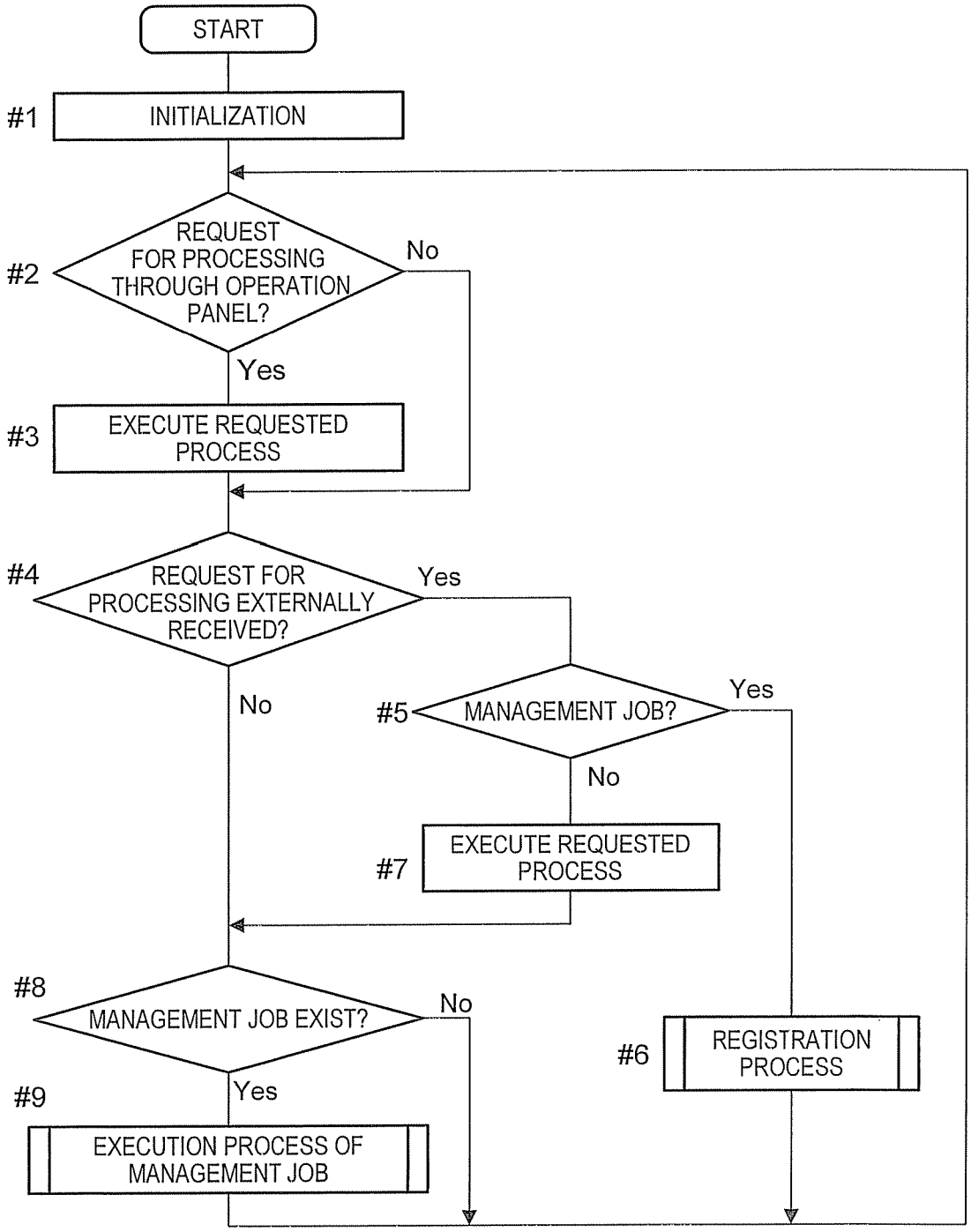
FIG. 4 is a flowchart depicting an example of an overall flow of a job management execution process performed by the image forming apparatus.
Figure 5:
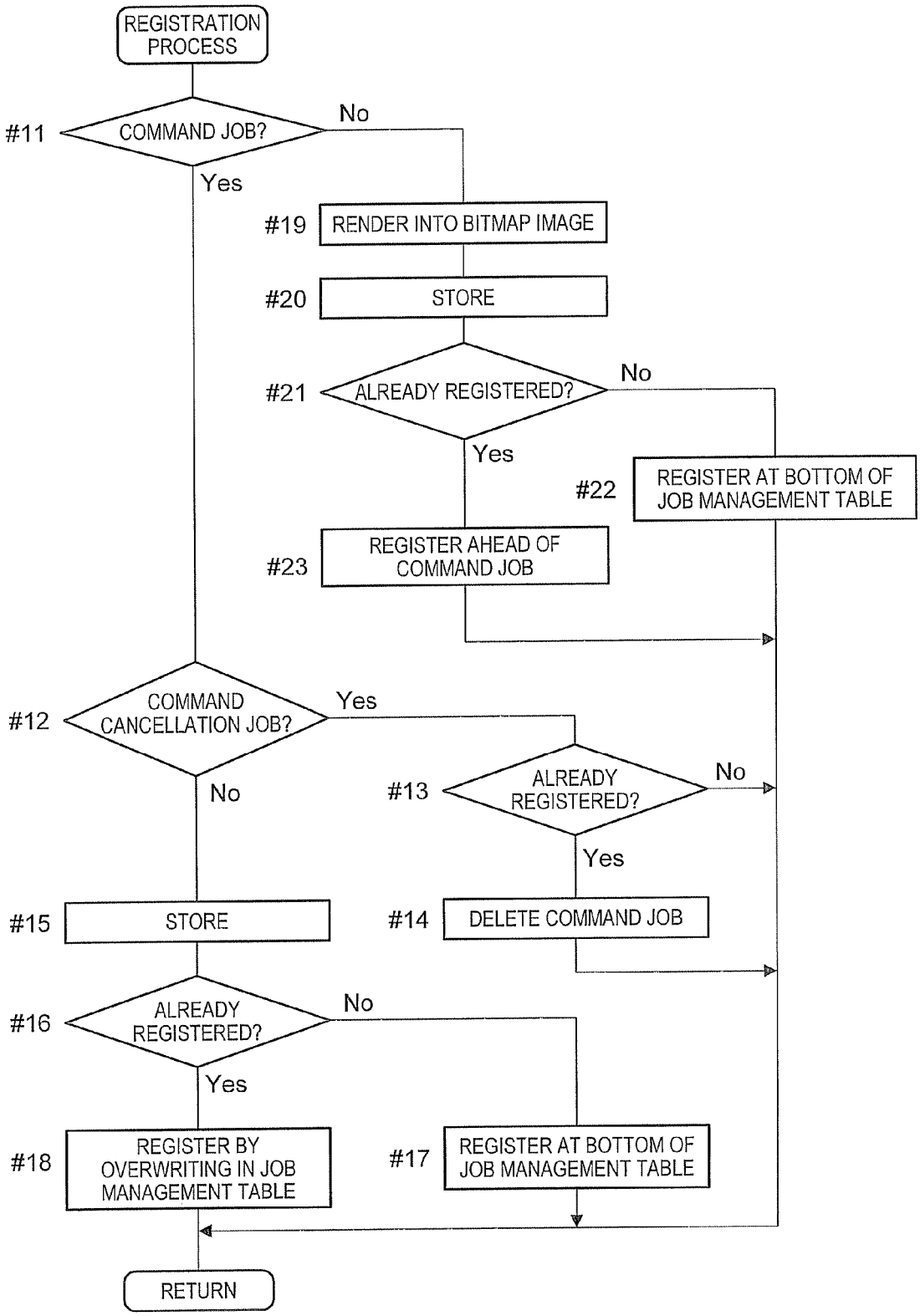
FIG. 5 is a flowchart depicting an example of a flow of a registration process.
Figure 9:
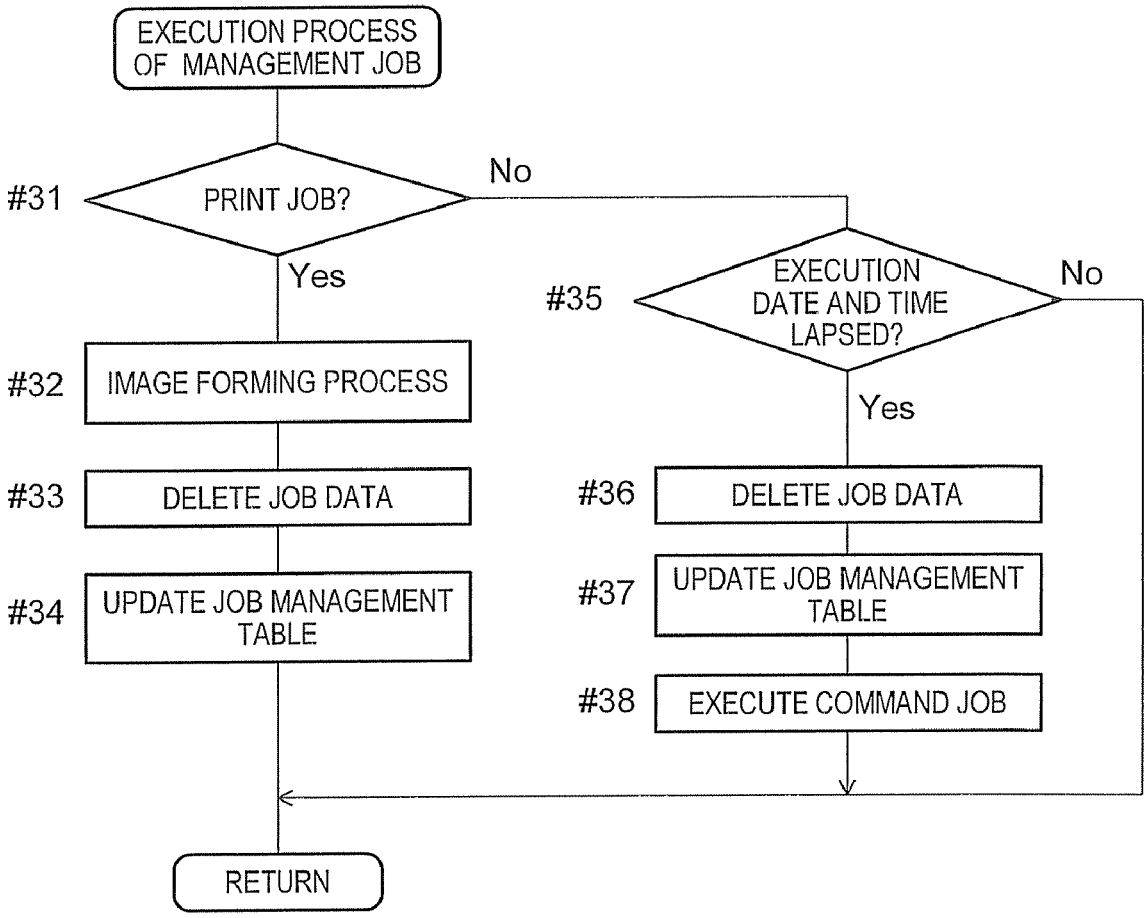
FIG. 9 is a flowchart depicting an example of a flow of an execution process of a management job.

FIG. 4 is a flowchart depicting an example of an overall flow of a job management execution process performed by the image forming apparatus 2; FIG. 5 is a flowchart depicting an example of a flow of a registration process; FIGS. 6A and 6B are diagrams illustrating an example of a job management table JT; FIG. 7 is a diagram illustrating an example of an execution date/time management table ZT; FIG. 8 is a diagram illustrating an example of the job management table JT; and FIG. 9 is a flowchart depicting an example of a flow of an execution process of a management job.

A power-on process or the like causes the CPU 101 to start processing. As illustrated in FIG. 4, an initialization process such as clearing data in a memory, activating the normal operation mode, and so on is performed first (#1).

Upon completion of the initialization process, it is determined whether or not there is a request for processing (copying, various settings, etc.) based on the operation by the user on the operation panel 130 (#2). If there is some type of request for processing (Yes in #2), then the requested process is executed (#3). Here, the request for processing from the user includes, for example, copying and scanning of a document, modifications to various settings stored in the NV-RAM 104, and so on.

If there is no request for processing from the user (No in #2), or there is a request but the request has been completed in step #3, then it is determined whether or not there is some kind of request for processing (printing process of document data, various settings, etc.) from an external apparatus such as the terminal apparatus 3 (#4).

If there is a request for processing from the external apparatus (Yes in #4), then it is determined whether or not the request for processing is a management job (#5).

Here, the management job corresponds to a print job and a command job registered in the job management table JT to be discussed later, or a command job stored in the fixed storage device 110.

If the request for processing is a management job (Yes in #5), then the registration process is performed (#6). Upon completion of the registration process, the processes described above will be repeated from the process in step #2. The detailed description of the registration process will be given later.

The management data relating to the management job is also known as "print data" which is generated by a printer driver based on a document to be printed and transmitted to the image forming apparatus 2. Hereinafter, the "print data" is referred to as management data.

The management data is expressed by a format in which a print command compiled in a popular PDL (Page Description Language) such as PCL or PostScript is encapsulated by PJL (Printer Job Language) which is a language for controlling a print job. The PDL also includes such a type of file format as PDF, TIFF, JPEG, and XPS.

Described below is an example of management data (print data) compiled by using PCL as a PDL.

```
%-12345X@PJL
@PJL JOB NAME="qwe.doc"
@PJL SET DUPLEX=OFF
@PJL SET SLEEP=OFF
@PJL SET SLEEPTIME=2230
@PJL SET PAPER=A4
@PJL ENTER LANGUAGE=PCL
[here comes print data of a document]
%-12345X
```

In this embodiment, this type of management data (print data) is used to control the image forming apparatus 2.

Referring back to FIG. 4, if the request for processing from the external apparatus is not a management job (No in #5), a process thus requested is performed (#7). Here, the request for processing that does not fall under the management job includes, for example, such a process as modifying various settings stored in the NV-RAM 104 etc.

On the other hand, if there is no request for processing from the external apparatus (No in #4) or there is a request but the request has been processed in step #7, it is then checked whether or not there is a management job registered in the job management table JT or a management job stored in the fixed storage device 110 (#8).

If there is a management job (Yes in #8), then the management job is executed (#9). The detailed description of the execution of the management process will be given later. On the other hand, if there is no management job (No in #8), the processes described above will be repeated from the process in step #2.

The procedure of the registration process is depicted in FIG. 5. Referring to FIG. 5, first, it is determined whether or not the management job is a command job (#11). In this process, if a command "@PJL SET SLEEP=ON", i.e., a command for turning the operation mode of the image forming apparatus 2 into the sleep mode, is found in the management data, then the management job is determined to be a command job. If such a command is not found in the management data, then the management job is determined as a print job.

If the management job is a command job (Yes in #11), then it is determined whether or not the command job is a command cancellation job for canceling execution of a command job (#12).

If the command job is a command cancellation job (Yes in #12), then it is determined whether or not a command job to be deleted has been registered in the job management table JT (#13).

If the command job to be deleted has been registered in the job management table JT (Yes in #13), then job information, which will be described later, corresponding to the command job to be deleted is deleted from the job management table JT, and job data corresponding to the command job to be deleted is deleted from the fixed storage device 110 (#14).

On the other hand, if the command job is not a command cancellation job (No in #12), then information of the command job and information of date and time at which the command job is executed (hereinafter, referred to as "execution date and time") are stored in the job storage portion 11, i.e., the NV-RAM 104 (#15).

For example, when the user wishes the operation mode to be turned into the sleep mode at 22:30, the information of execution date and time of the management data is expressed as "@PJL SET SLEEPTIME=2230".

Next, it is determined whether or not the command job has been already registered in the job management table JT (#16).

If the command job has not been registered (No in #16), then the job management portion 12 registers the command job at the bottom of the job management table JT, as illustrated in FIG. 6A (#17).

The job management table JT stores therein job information JJ configured of a job ID indicating identification information, a type of management job (i.e., print job or command job), a document name indicated in the parameter "@PJL JOB NAME", received date and time, and a filename of job data.

In this embodiment, the management jobs are executed sequentially by the job control portion 12 in descending order from the management job that is registered at the top of the job management table JT (top in the illustration).

Therefore, by registering a command job at the bottom of the job management table, a print job is always executed ahead of the command job.

At the same time, even if the date and time, at which execution of all registered print jobs has been completed, passes beyond the execution date and time of the command job which is preprogrammed by the user, the command job is not executed at the execution date and time thus preprogrammed but is always executed after all the registered print jobs have been completed.

The job storage portion 11 stores an execution date/time management table ZT. As illustrated in FIG. 7, the execution date/time management table ZT stores a job ID that corresponds to the job ID of the command job in the job management table JT illustrated in FIG. 6B and execution date/time information ZJ compiled from the information of execution date and time of the command job.

On the other hand, if the command job has been already registered (Yes in #16), as illustrated in FIG. 6B, the command job which has been already registered and has an job ID "0104" is overwritten by the command job having an job ID "0110" (#18). Both of the command jobs are command jobs for "activating power-saving mode". In this case, information of received date and time is updated.

On the other hand, if the management job that has been received is a print job (No in #11), data corresponding to the print job is rendered into a bitmap image from a print command compiled in PDL (#19). The image data thus rendered is stored in the fixed storage device 110 as job data together with print mode information indicating whether printing is performed on a single side or double sides of paper etc. (#20).

Next, it is determined whether or not a command job has been registered in the job management table JT (#21). If a command job has not been registered (No in #21), then the job management portion 10 registers the above-mentioned print job at the bottom of the job management table JT (#22).

On the other hand, if a command job has been registered (Yes in #21), then the job management portion 10 registers the above-mentioned print job ahead of the command job in the job management table JT (#23). One example of this process will be as follows. As illustrated in FIG. 8, a print job having a job ID of "0111" is registered ahead of a command job which has been already registered in the job management table JT and has a job ID of "0104".

Next, a detailed description will be given of the execution process of the management job in step #9.

Referring to FIG. 9, first, it is determined whether or not a management job registered at the top of the job management table JT is a print job (#31). If the management job registered at the top is a print job (Yes in #31), image data is read out from job data stored in the fixed storage device 110, and an image is formed therefrom (#32).

Then, the subject job data is deleted from the fixed storage device 110 (#33), and job information JJ corresponding to the subject print job is deleted from the job management table JT to thereby update the job management table JT (#34).

On the other hand, if the management job registered at the top of the job management table JT is not a print job, meaning it is a command job instead (No in #31), it is determined, based on the execution date/time management table ZT, whether or not the execution date and time of the command job has lapsed (#35).

If the execution date and time thereof has lapsed (Yes in #35), job data corresponding to the command job and stored in the fixed storage device 110 is temporarily stored in the RAM and deleted thereafter from the fixed storage device 110 (#36). Then, job information JJ corresponding to the command job is deleted from the job management table JT (#37), and then the command job is executed based on the job data that has been temporarily stored (#38). In this case, for example, if the command job is such a job that instructs the image forming apparatus 2 to turn the operation mode thereof into the sleep mode, the operation mode is turned into the sleep mode.

Figure 10:
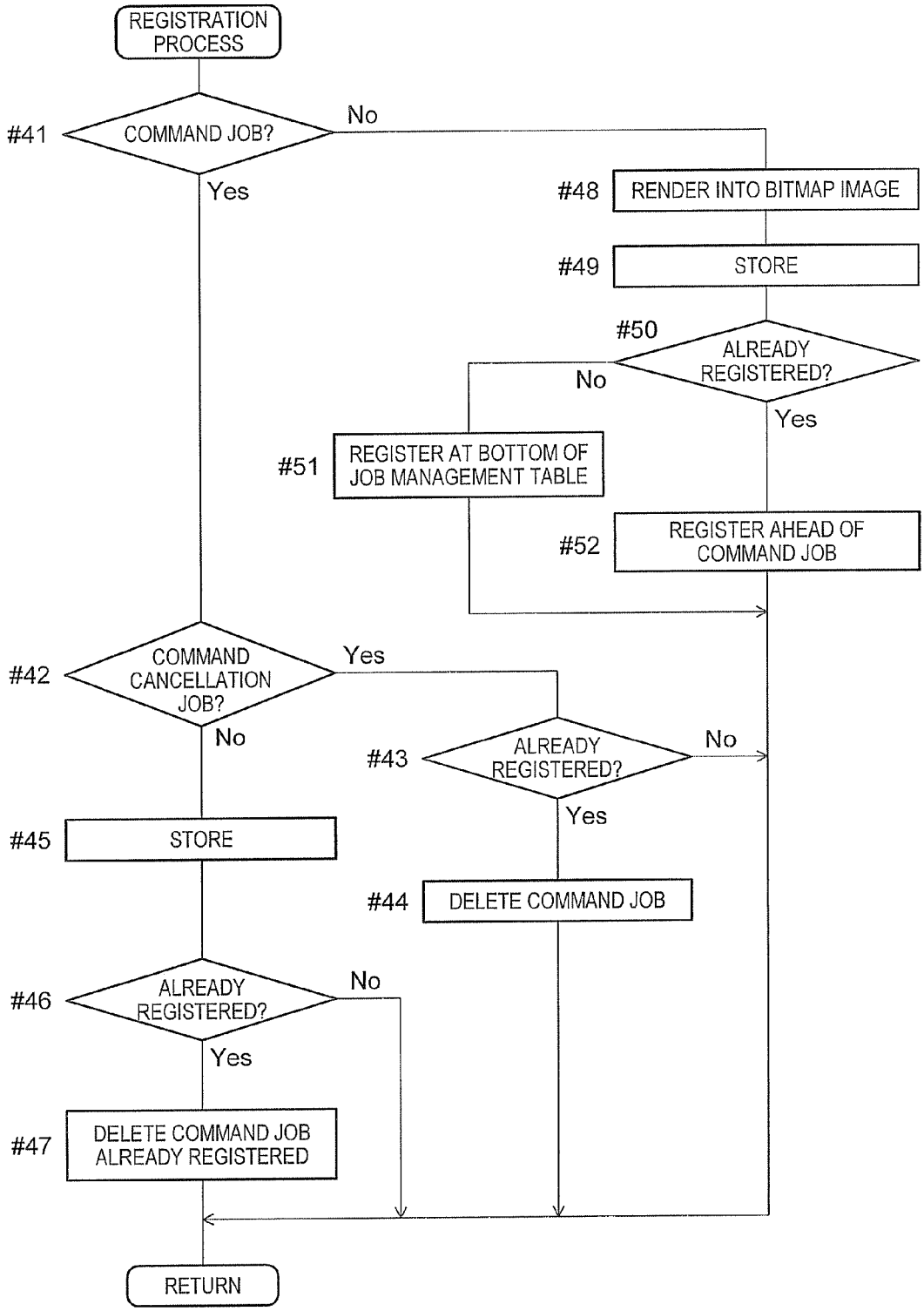
FIG. 10 is a flowchart depicting another example of a flow of the registration process.
Figure 11:
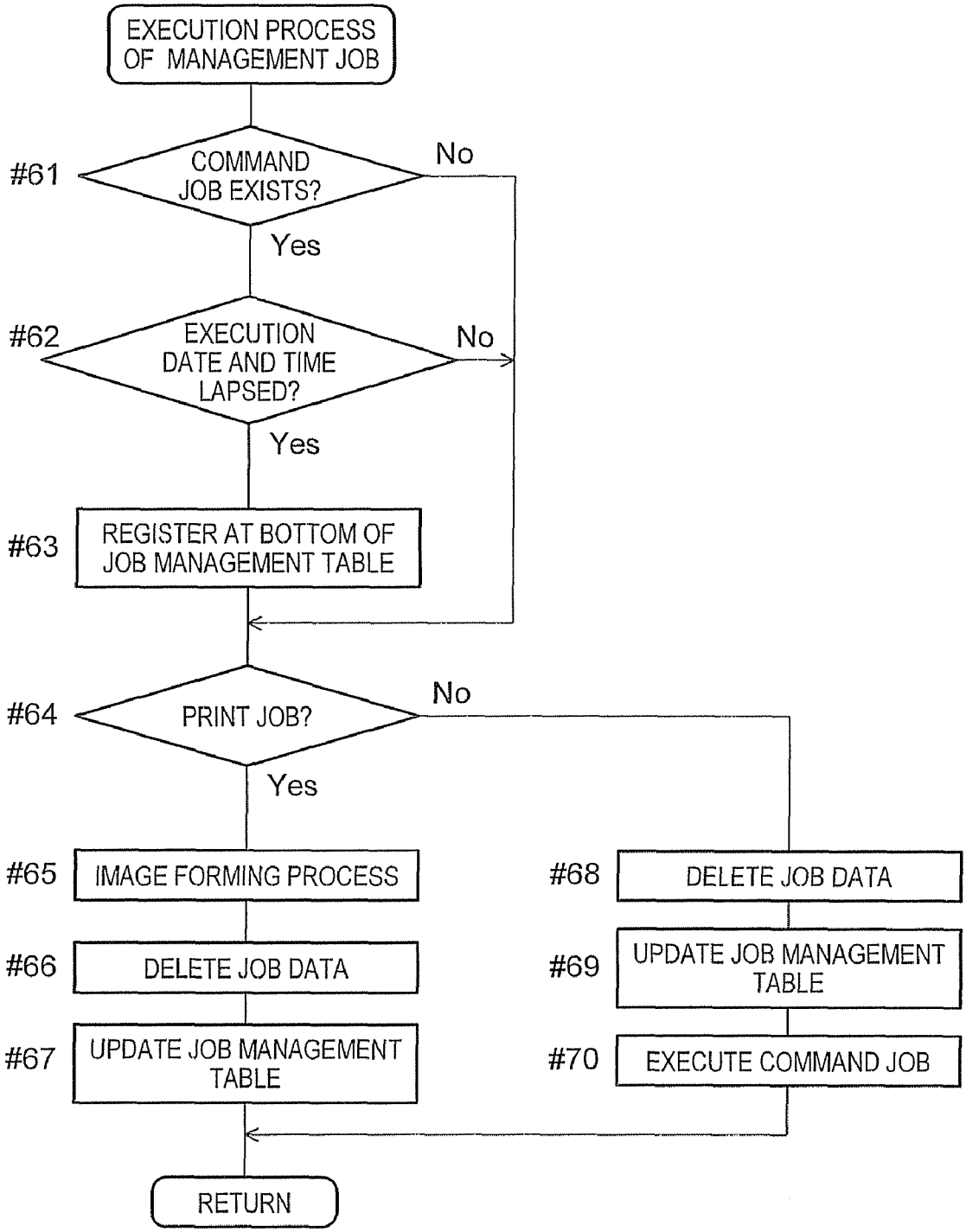
FIG. 11 is a flowchart depicting another example of a flow of the execution process of a management job.

FIG. 10 is a flowchart depicting another example of a flow of the registration process, and FIG. 11 is a flowchart depicting another example of a flow of the execution process of the management job.

In the process discussed above, exemplified is a case where a received command job is registered in the job management table JT regardless of the execution date and time thereof. However, in the example described below, the command job is registered in the job management table JT only when the execution date and time thereof has lapsed but not registered prior to such a moment.

As illustrated in FIG. 10, first, it is determined whether or not the management job is a command job (#41). If the management job is a command job (Yes in #41), then it is determined whether or not the command job is a command cancellation job (#42).

If the command job is a command cancellation job (Yes in #42), then it is determined whether or not a command job to be canceled has been registered in the job management table JT (#43).

If the command job to be deleted has been registered in the job management table JT (Yes in #43), then job information JJ, corresponding to the command job to be deleted, is deleted from the job management table JT, and job data corresponding to the command job to be deleted is deleted from the fixed storage device 110 (#44).

On the other hand, if the command job is not a command cancellation job (No in #42), then the command job is stored in the job storage portion 11 (NV-RAM 104) (#45).

Next, it is determined whether or not the command job has been already registered in the job management table JT (#46). If the command job has been registered (Yes in #46), then the registered command job is deleted from the job management table JT (#47), whereas, if the command job has not been registered (No in #46), the registration process ends.

On the other hand, if the management job that has been received is a print job (No in #41), data corresponding to the print job is rendered into a bitmap image from a print command compiled in PDL (#48). The image data thus rendered is stored in the fixed storage device 110 as job data together with such an item as print mode information indicating whether printing is performed on a single side or double sides of paper etc. (#49).

Next, it is determined whether or not a command job has been registered in the job management table JT (#50). If a command job has not been registered (No in #50), then the subject print job is registered at the bottom of the job management table JT (#51).

On the other hand, if a command job has been registered (Yes in #50), then the subject print job is registered ahead of the command job in the job management table JT (#52).

Next, another example of the execution process of the management job will be described.

Referring to FIG. 11, first, it is determined whether or not a command job is stored in the fixed storage device 110 (#61). If a command job is stored (Yes in #61), then it is determined whether or not the execution date and time of the command job has lapsed (#62).

If the execution date and time has lapsed (Yes in #62), then the command job stored in the fixed storage device 110 is registered at the bottom of the job management table JT (#63). In this way, only when the execution date and time has lapsed, the subject command job is registered in the job management table JT.

If a command job is not stored (No in #61) or it is stored but the execution date and time thereof has not lapsed (No in #62), the process moves to step #64 described below.

Then, it is determined if the management job registered at the top of the job management table JT is a print job (#64). If the management job registered at the top is a print job (Yes in #64), image data is read out from job data stored in the fixed storage device 110, and an image is formed therefrom (#65).

Then, the subject job data is deleted from the fixed storage device 110 (#66), and job information JJ corresponding to the print job is deleted from the job management table JT to thereby update the job management table JT (#67).

On the other hand, if the management job registered at the top of the job management table JT is not a print job, meaning it is a command job instead (No in #64), job data corresponding to the subject command job is deleted from the fixed storage device 110 (#68). Then, job information JJ corresponding to the subject command job is deleted from the job management table JT (#69), and the subject command job is executed (#70). In this case, for example, if the command job is such a job that instructs the image forming apparatus 2 to turn the operation mode thereof into the sleep mode, the operation mode is turned into the sleep mode.

According to one aspect of this embodiment, a command job including a description of a command for controlling the operation mode of the image forming apparatus 2 is collectively managed together with a print job that issues an instruction for executing an image forming process. With this arrangement, the user can easily configure a command job in such a maneuvering feeling as if the user transmitted a print job.

Furthermore, according to another aspect of this embodiment, a command job is registered at the bottom of the job management table JT, or, if a command job has been already registered in the job management table JT, a print job is registered ahead of the command job. Consequently, the print job is always executed prior to the command job.

With this arrangement, the user does not need to estimate the time at which all print jobs have been completed and thereby configure the execution date and time of the command job which issues an instruction for activating the sleep mode. Accordingly, it is possible to securely prevent a print job from being interrupted by a command job during the execution of the print job, which otherwise occurs if the time at which all print jobs are completed is wrongly configured.

Conventionally, when the number of new print jobs is increased and registered, it is burdensome for the user to change the configuration of the execution date and time of the command job. According to this embodiment, however, even when a new print job is required, the print job is registered ahead of the command job in the job management table JT, so that the print job is always executed ahead of the command job. This saves the user from a burdensome task.

According to another aspect of this embodiment, if it becomes necessary to change the execution date and time of a command job temporarily, e.g., from one day to another, it is not necessary to configure the execution date and time for each day as conventionally required because the print job is always executed ahead of the command job, offering convenience to the user.

If each print job is not transmitted by an identical user or a print job and a command job are transmitted by different users, conventionally, it is extremely troublesome to preprogram sets of execution date and time of the command job based on the requirements of individual users. However, according to this embodiment, such a burden as incurred conventionally is no longer present because the print job is always executed ahead of the command job.

When the execution date and time has just lapsed or lapsed away, the command job is executed. This allows the user not to stand by.

According to still another aspect of this embodiment, by using a command cancel job, it is possible to cancel a command job that was entered.

With this arrangement, according to the image forming apparatus 2 in this embodiment, the execution of a job can be configured easier and simpler than conventionally possible.

Other Embodiments

In the embodiment described above, the description has been given of a case where a command job is transmitted from an external device such as the terminal apparatus 3 to the image forming apparatus 2. However, it is also possible to adopt a configuration in which a command job is entered through the operation panel 130 of the image forming apparatus 2.

Further, in the embodiment described above, the job management portion 10 is arranged separately from the job control portion 12. However, it is also possible to configure the job management portion 10 to have functions of the job control portion 12. This means that control is performed so that the job management portion 10 not only registers a management job in the job management table JT but also a print job is always executed ahead of a command job based on the job management table JT.

Finally, the configuration and functions of all or part of the image forming apparatus 2, the details or order of the processing performed thereby and so on can be modified in various ways within the spirit of the present invention. The above-mentioned unique and distinguished effects can also be attained in such a case as well.

While the embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. An image forming apparatus capable of executing a job of a process including an image forming process, comprising:

a job storage portion that stores a print job relating to the image forming process and a command job relating to a control process of operation of the image forming apparatus;

a job management portion that registers the print job and the command job in the job storage portion and manages the print job and the command job;

an image formation portion that executes the print job;

a command execution portion that executes the command job; and a controller that performs control such that the print job stored in the job storage portion is executed ahead of the command job;

a command job storage portion that stores the command job;

wherein the command job includes information of date and time at which the command job is supposed to be executed;

the controller performs control such that the command job is executed when the date and time included in the information of date and time has lapsed; and the job management portion registers the command job stored in the command job storage portion into the job storage portion when the date and time included in the information of date and time has lapsed.

2. The image forming apparatus according to claim 1, wherein the command job is a job that turns off power of the image forming apparatus.

3. The image forming apparatus according to claim 1, wherein the image forming apparatus has a normal operation mode and a power-saving mode in which less power is consumed than in the normal operation mode, and the command job is a job that turns the normal operation mode into the power-saving mode.

4. The image forming apparatus according to claim 1, wherein, when the command job is received by the job management portion and if the job storage portion already registers therein another command job that is identical with the command job thus received, the job management portion avoids overlap of registration.

5. The image forming apparatus according to claim 1, wherein the command job includes a command cancellation job that deletes the command job from the job storage portion or the command job storage portion, and the job management portion deletes the command job from the job storage portion or the command job storage portion when the job management portion receives the command cancellation job.

6. A job execution method capable of executing a job of a process including an image forming process performed by an image forming apparatus, comprising the steps of:

registering and managing a print job relating to the image forming process and a command job relating to a control process of operation of the image forming apparatus, performing control such that the print job is executed ahead of the command job;

storing the command job in a command job storage portion;

wherein the command job includes information of date and time at which the command job is supposed to be executed, and control is performed in such a way that the command job is executed when the date and time included in the information of date and time has lapsed; and registering the command job stored in the command job storage portion into a job storage portion when the date and time included in the information of date and time has lapsed.

7. The job execution method according to claim 6, wherein the command job is a job that turns off power of the image forming apparatus.

8. The job execution method according to claim 6, wherein the image forming apparatus has a normal operation mode and a power-saving mode in which less power is consumed than in the normal operation mode, and the command job is a job that turns the normal operation mode into the power-saving mode.

9. The job execution method according to claim 6, wherein, when the command job is received and if another command job that is identical with the command job thus received is registered, overlap of registration are avoided.

10. The job execution method according to claim 6, wherein the command job includes a command cancellation job that deletes the command job from the job storage portion or the command job storage portion, and the command job is deleted from the job storage portion or the command job storage portion when the command cancellation job is received.

* * * * *